United States Patent [19]

Chronic

[11] 4,182,118

[45] Jan. 8, 1980

[54] JET PROPULSION ENGINE

[76] Inventor: Bill M. Chronic, 2704 Woodlawn Ave., Boise, Id. 83702

[21] Appl. No.: 514,162

[22] Filed: Nov. 20, 1974

Related U.S. Application Data

[63] Continuation-in-part of Ser. No. 376,251, Jul. 3, 1973, abandoned, which is a continuation of Ser. No. 135,267, Apr. 18, 1971, abandoned.

[51] Int. Cl.[2] ..... F02K 1/22

[52] U.S. Cl. ..... 60/221; 60/269; 115/14; 415/199.1

[58] Field of Search ..... 60/221, 269, 222; 415/199.1, 191–193, 182; 115/11, 14–16

[56] References Cited

U.S. PATENT DOCUMENTS

| | | | |
|---|---|---|---|
| 3,112,610 | 12/1963 | Jerger | 60/221 |
| 3,143,857 | 8/1964 | Eaton | 60/221 |
| 3,286,641 | 11/1966 | Delao et al. | 60/221 |
| 3,328,961 | 7/1967 | Aschauer | 60/221 |
| 3,678,689 | 7/1972 | Ishiwata | 60/221 |

*Primary Examiner*—Robert E. Garrett

[57] ABSTRACT

The jet propulsion engine employs a duct modified from a theoretical taper to be enlarged in transverse cross-section along the duct by an amount equal to the area of a cross-section through impellers and stators at any point along the duct. The tube radius at any point $r_n$ is equal to a geometrical development:

$$r_n = \sqrt{\frac{\pi (r_F^2 - r_H^2 + r_{Hn}^2) - dA\, l_n}{\pi}}$$

2 Claims, 4 Drawing Figures

JET PROPULSION ENGINE

REFERENCE TO OTHER APPLICATIONS

This application is a continuation-in-part of prior application Ser. No. 376,251 filed July 3, 1973, now abandoned, which was a continuation of Ser. No. 135,267 filed Apr. 18, 1971, now abandoned.

FIELD OF INVENTION

The present invention relates to a jet propulsion device, and more particularly to a jet propulsion device operable to accelerate fluid with a uniform pressure head by an improved, modified duct.

DESCRIPTION OF THE PRIOR ART

It is an inherent and ever present problem with all fluid propulsion devices that high acceleration of the fluid results in cavitation. This problem is accentuated in shrouded or jet propulsion devices in which high acceleration takes place in a closed duct or housing.

Improvements in jet propulsion engines have been directed primarily to the geometry of certain components for minimizing of cavitation affects while maximizing propulsive force on the fluid through the duct. Thus, the minimization of the cavitation effect has been approached by a modification of a theoretical blade curvature optimized for applying force on the fluid to a blade cord which is not so susceptible to cavitation. Alternatively, effort has been made to shroud the main shaft carrying impeller blades to limit the volume of fluid in the duct, thus minimizing cavitation (cf. J. J. Jerger, U.S. Pat. No. 3,112,610, Dec. 3, 1963).

This results in a dichotomous trade-off of a low fluid acceleration to power ratio, as a means of limiting cavitation, or an attempt to eliminate cavitation itself. It may be seen that the air foil modification approach, which limits the lifting capacity of the blades, inherently results in mechanical efficiency while, in fact, not reducing the effects of cavitation in a closed duct. The alternative approach of the prior art of stream-lining the main shaft shroud, to limit the volume of water at any station within the duct, attempts to relieve the cavitation problem by reducing the amount of fluid acceleration rather than the amount of accelerative force applied per blade.

Accordingly, it is an object of the present invention to provide a jet propulsion device having a duct modified from a theoretical taper to be enlarged at each cross-section by an amount substantially equal to the cross-sectional area of corresponding section through shafts and blades.

If is a further object of this invention to minimize cavitation while permitting use of impeller and stator blades which are, in the main, optimized for their lifting capacity.

It is intended that, by accomplishing these objects, cavitation be minimized while the efficiency of fluid accelerated to power be maximized.

These and other objects shall become apparent from the description following, it being understood that modifications may be made without affecting the teachings of the invention here set out.

SUMMARY OF THE INVENTION

The jet propulsion engine employs a duct modified from a theoretical taper to be enlarged in transverse cross-section along the duct by an amount equal to the area of a cross-section through impellers and stators at any point along the duct. The tube radius at any point $r_n$ is equal to a geometrical development:

$$r_n = \sqrt{\frac{\pi\,(r_E^2 - r_H^2 + r_{Hn}^2) - dA\,l_n}{\pi}}$$

A more thorough and comprehensive understanding may be had from the detailed description of the preferred embodiment when read in connection with the drawings forming a part of this specification.

DETAILED DESCRIPTION OF THE PREFERRED EMBODIMENT

Figure 1:
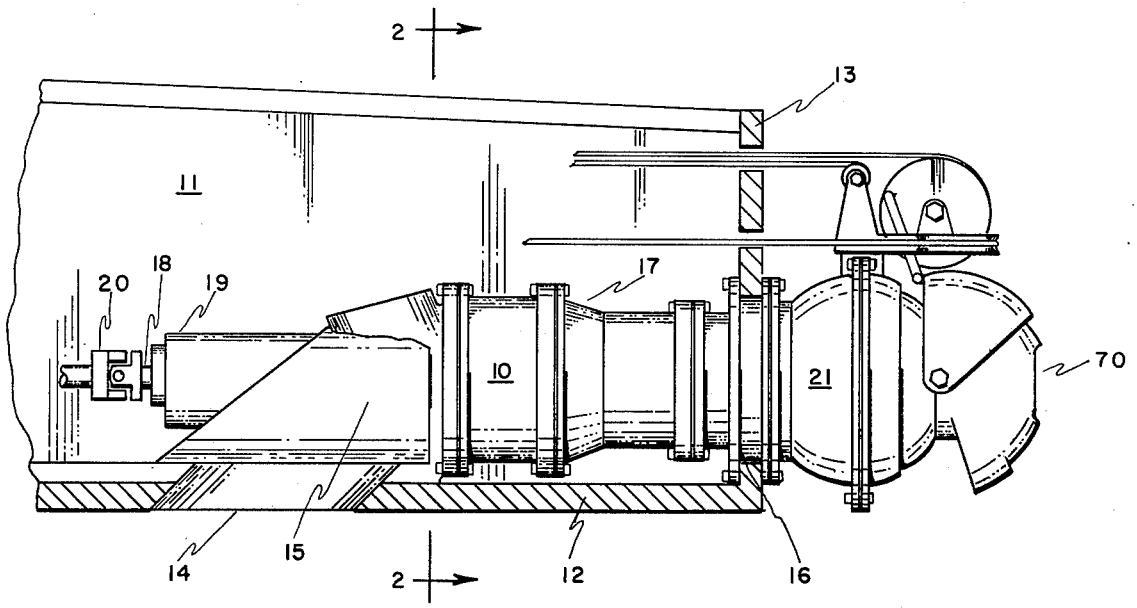
FIG. 1 is a side elevational view of the jet propulsion engine of the present invention showing to advantage the engine mounted in the aft portion of a hull of a vessel having a bulkhead removed for illustrative purposes and shown in a fragmentary cross-section.

Referring now to the drawings and more particularly to the FIG. 1, the jet propulsion engine of the present invention is shown to advantage and generally identified by the numeral 10. The engine 10 is mounted in the aft end, or stern section, of a boat identified for illustrative purposes by the numeral 11. The boat 11 includes a bottom hull 12 and a bulkhead or transom 13. The hull 12 is provided with an entranceway 14 adjacent a transitional entranceway portion 15 of the engine 10 hereinafter later described. The transom 13 is provided with an opening 16 in which the engine 10 may be mounted. The engine 10 includes a tapered, tubular housing 17 attached to the transitional entranceway portion 15 which provides an intake to the engine 10. Water may be pumped into the housing 17 through the entranceway 14 of the boat 11 and through the transitional entranceway portion into the housing 17, as hereinafter later described. In practice, it has been found to advantage to provide a grating or screen (not shown) between the entranceway 14 and the transitional entranceway 15 to prevent debris from entering the engine 10. It has been found preferrable to form the housing 17 into sections bolted together substantially, as more clearly shown in the cross-sectional view of FIG. 2.

Referring again to the FIG. 1, the engine 10 further includes a driven shaft 18 journaled for rotation in pillow-bearings 19. The shaft 18 is connected to a suitable driving assembly 20 such as coupling to a commonly known motor or engine (not shown). A steering nozzle 21 of the sort described in U.S. Pat. No. 3,143,857 to H. J. Eaton, or in my copending application Ser. No. 492,554, may be provided at the terminal end of the housing 17. The nozzle 21 is mounted to the housing 17 after the transom 13.

Referring again to the FIG. 2, the volume, enclosed by the housing 17 to the shaft 18, describes a tapered duct which narrows from the entranceway 14 to the exitway 70. The driven shaft 18 carries a series of impellers 22, 23 and 24, which are mounted at the entranceway midway and adjacent the exitway in the duct. Blades 25, 26 and 27 of the respective impellers 22, 23 and 24 issue radially from the shaft 18 from rotation within the housing 17. A series of stators 28, 29 and 30 are disposed alternately between the impeller 22, 23 and 24. Blades 31, 32 and 33 of the respective stators 28, 29 and 30 issue radially from the hubs to the housing 17 to form pillow-blocks carrying the driven shaft 18. The rearwardmost stator 30 may be mounted to a tapered or cone-shaped farring which may carry a pillow-block (not shown).

The pitch and camber of the respective stators 28, 29 and 30 are opposite to that of the pitch of the impellers 22, 23 and 24. In order that the stream of fluid may emerge as aligned rather than spiraled at each stage of acceleration and at the exitway 70. The stators 28, 29 and 30 are provided with the blades 31, 32 and 33 which have a curved, air foil configuration which is operable to direct fluid following a centripetal path, due to the swing effect of the blades into a straight-line flow through the duct. The respective blades are mounted with their main chord in alignment with the rectilinear center line of the driven shaft 18, with the interior curvature disposed in an opposing direction to the interior curvature formed by blades of the adjacent impellers.

Figure 3:
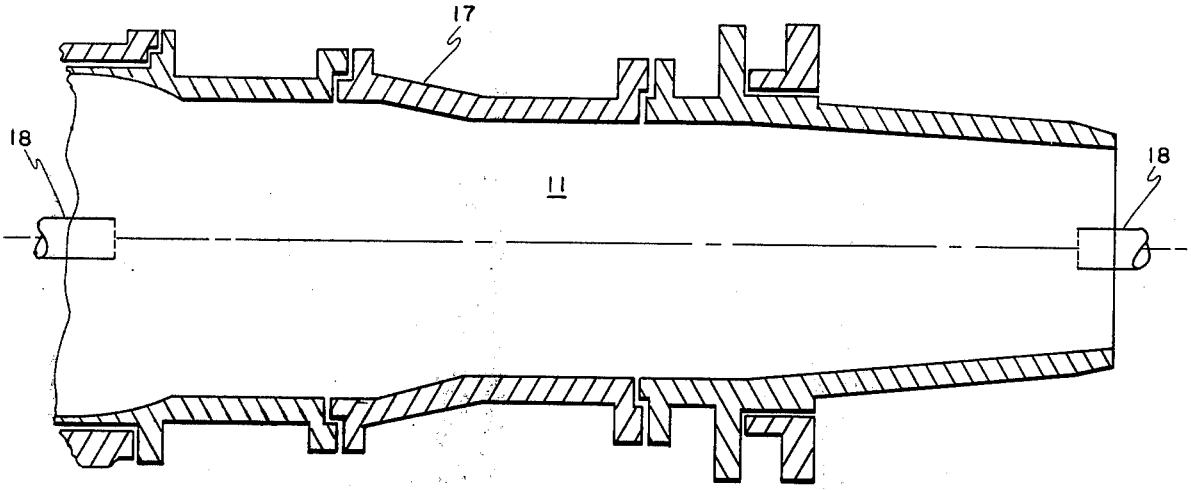
FIG. 3 is a cross-sectional view of the housing of the present jet propulsion engine showing more clearly the profile of the duct formed by the housing.
Figure 4:
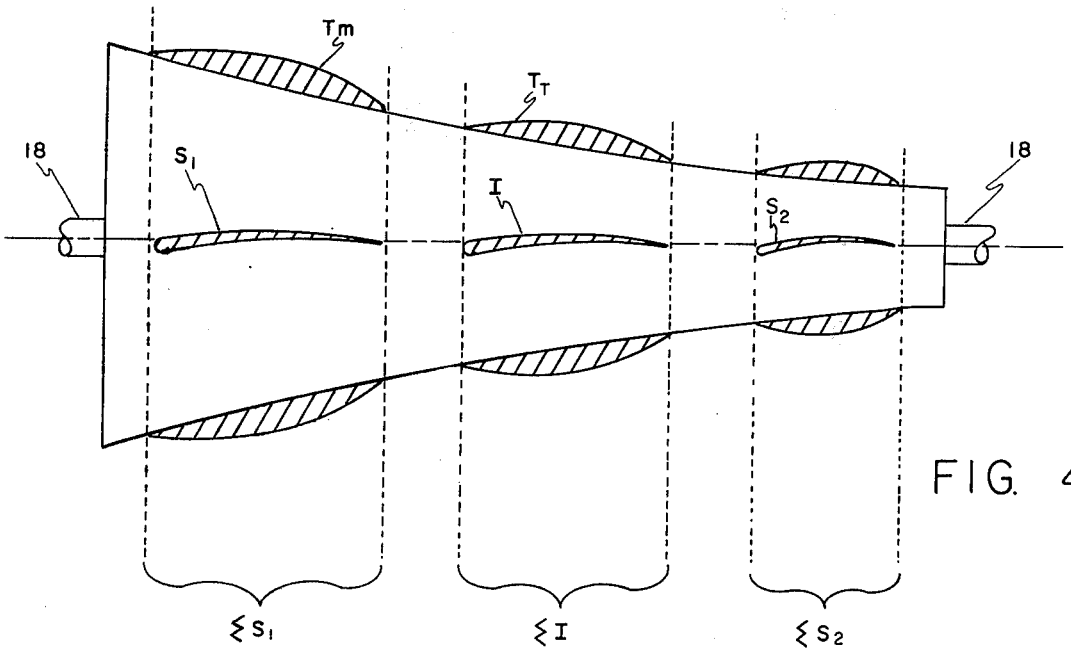
FIG. 4 is a semi-diagrammatic view of the profile taken from the FIG. 3 as compared to the taper of a theoretical jet propulsion tube.

Referring now to the FIGS. 3 and 4, the duct formed by the housing 17 is modified to produce constant acceleration of a fluid throughout the duct and increases the velocity head without effecting an adverse change in the pressure head of the fluid within the housing 17. In essence, the cross-sectional area at any point in the housing 17 is enlarged from an ideal taper by an amount substantially equal to the material thickness of the blades of the respective impellers and stators, the driven shaft 18 and the like. The following calculations develop the configuration of the ideal tube, shown as broken lines in the FIG. 4. The cross-sectional area of the entranceway:

$$A_E=\pi r_E^2-\pi r_H^2=\pi(r_E^2-r_H^2)$$

At the exitway:

$$A_X=\pi r_X^2$$

assuming that the main shaft 17 ends before reaching the exitway 70. The radius at the entranceway 14 ($A_E$) is assigned to be greater than the radius of the exitway 70 ($A_X$). The reduction in net cross-sectional area of the housing is:

$$\Delta A=\pi(r_E^2-r_H^2-r_X^2)$$

For the purposes of this invention, the terms "ideal tube" and "ideal geometrical taper" are used synonymously and are defined as follows:

An "ideal tube" is defined as the inside surface of a closed conduit open at both ends. The ideally geometrical, tapered surface is generated by a family of circles lying in perpendicular tranverse planes to the axis of the conduit. The centers of all said circles lie along the longitudinal axis of said conduit. The tube's surface develops from an infinite number of circles whose radii must decrease at a rate (fore to aft) to produce a reduction of cross sectional area inversely proportional to the increase in velocity of a fluid progressing along the tube from fore to aft, so that the acceleration of that fluid is constant in the tube. That is, the rate of change of fluid velocity from the entrance to the exit is constant at any given moment.

Since, in the tube, the quantity of fluid "Q" passing any point "n" must be equal to that passing any other point in the tube at the same moment of time, $Q=$(net cross-sectional area)(Velocity)$=AV=\pi r^2V$. Since $\pi$ is constant, $r^2$ must vary inversely proportional to the velocity, "V," at any point "n" along the axis of the tube.

This condition produces the ideal geometry of the inside tube surface and the invention, which is to produce uniform acceleration of the fluid passing through the tube, thus increasing the velocity head without materially changing the pressure head.

In order to assist in the understanding of the equations to be developed, the following terms are defined:

- Q=Quantity of fluid passing a given point "n" in the closed tube 17 per interval of time.
- L=The length of the tube 17 measured axially from the entrance to the exit.
- $l_n$=The length from the entrance 14 of the tube to any point "n" along the longitudinal axis of the tube.
- V=Mean velocity of the fluid of a given cross-sectional area at a given point "n" along the longitudinal axis of the tube.
- $\Delta V$=The change of velocity of the fluid between the entrance and exit of the tube.
- dV=The incremental change of $\Delta V$ per unit of length of the tube measured along the longitudinal axis 18. The change in velocity per unit of time is acceleration and is held constant throughout the tube at any moment of time, for design.
- $V_E$=Mean velocity of the fluid at the entrance 14 of the tube.
- $V_n$=Mean velocity at any point "n" in the tube.
- $V_x$=Mean velocity of the fluid at the exit 70 of the tube
- A=The net cross sectional area of the tube 17 at any point "n" taken in a plane perpendicular to the longitudinal axis 18 of the tube.
- $\Delta A$=The change of net fluid cross-sectional area between the entrance 14 and exit 70 of the tube.
- dA=The incremental change of $\Delta A$ per unit of length of the tube.
- $A_E$=Net cross-sectional fluid area at the tube entrance 14.
- $A_n$=Net cross-sectional fluid area at any point "n" along the tube.
- $A_x$=Net cross-sectional fluid area at the exit 70 of the tube.
- $r_E$=Radius of the inside of the ideal tube at the entrance.
- $r_H$=Radius of the impeller hub 22 at the entrance of the tube 17.
- $r_{Hn}$=Radius of the equivalent hub area which includes the blade areas of the impellers, or stators, at any section taken at point "n" along the longitudinal axis of the tube 18.
- $r_x$=Radius of the inside of the ideal tube at the exit where $l_n$=L.

$r_n$=The radius of the inside circular surface of the "ideal tube" or the "modified ideal tube" at any point "n" along the longitudinal axis of the "tube."

$dAl_n=\pi r_E^2-\pi r_H^2-(\pi r_n^2-\pi r_{Hn}^2)$ $dAl_n=\pi r_E^2-\pi r_H^2-\pi r_n^2+\pi r_{Hn}^2$ $\pi r_n^2=\pi(r_E^2-r_H^2+r_{Hn}^2)-dAl_n$ $$r_n^2=\left[\frac{\pi(r_E^2-r_H^2+r_{Hn}^2)-dA\,l_n}{\pi}\right]$$

$$r_n^2=\sqrt{\frac{\pi(r_E^2-r_H^2+r_{Hn}^2)-dA\,l_n}{\pi}}$$

This is the general equation for the invention. In the ideal tube application, since there are no hubs, impeller or stator blades considered, the terms $r_H$ and $r_{Hn}$=zero. Therefore, those terms drop out of the equation, and the form is reduced to:

$$r_n=\sqrt{\frac{\pi r_E^2-dA\,l_n}{\pi}}.$$

In the modified ideal tube application of the equation between the stator and impeller blades (measured axially along the tube), it should be recognized that $r_H$ and $r_{Hn}$ are equal in the general form of the equation, thus cancelling each other out and again reducing the general equation identical to that of the ideal tube.

$$r_n=\sqrt{\frac{\pi r_E^2-dA\,l_n}{\pi}}$$

For all other conditions, it is necessary to apply the general form of the equation, since $r_H$ and $r_{Hn}$ are neither zero nor equal, except from the last stator blade to the exit 70, where they may both become zero.

Thus, taking an infinite number of transverse cross-sections through the engine 10, which provides cross-sections of material due to the presence of respective impeller or stator and the driven shaft 18, results in a modification of an ideal tube to a constant pressure-head-producing tube here shown as an enlargement by cross hatching in FIG. 4 of the ideal tube configuration of the interior surface of the housing 17. In operation, water is pumped into the housing 17 by rotation of the impellers 28, 29 and 30 as with conventional jet propulsion devices. As water is pumped through the housing 17, the velocity head of the water tends to be increased at a rate satisfying the equation $\overline{Q}=AV$. The pressure head, thus generated, will be relatively uniform throughout the system and internal friction and loss of internal cohesion of the fluid, which results in cavitation, will be minimized.

Referring now more particularly to the FIG. 4, where a semi-diagrammatic view of a profile of a jet pump is shown superimposed upon an ideally theoretically curved tube or venturi showing typical cross-sections of blades.

Figure 2:
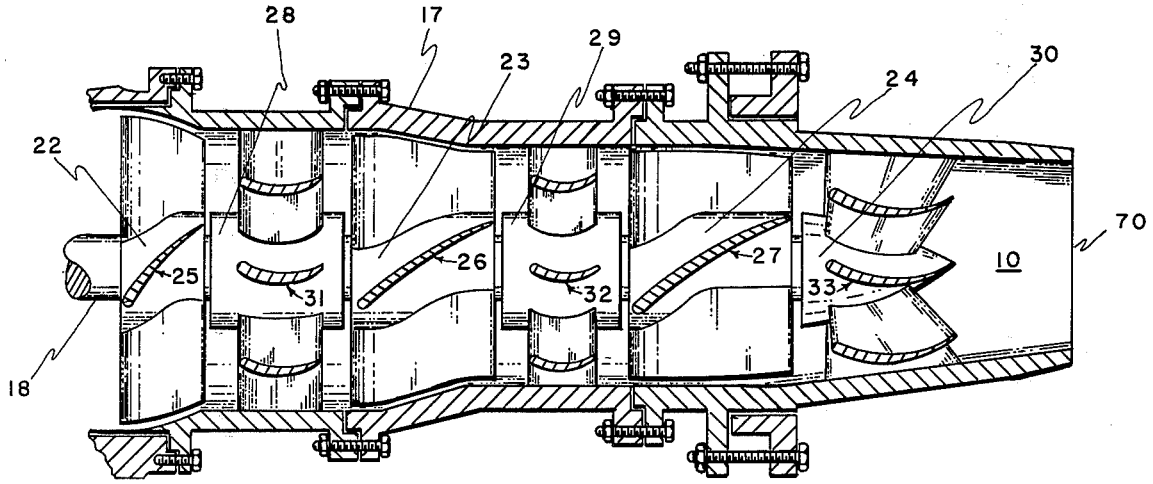
FIG. 2 is a cross-sectional view of the jet propulsion engine of this invention taken substantially along the lines 2—2 of the FIG. 1 and showing to advantage the ventury-like housing of the engine and the arrangement of a plurality of impellers and stators in the housing.

The zone $T_m$ is approximately equal to the cross sectional area of the stator $S_1$ with its attendance fittings. The enlarged portion T is equal to cross sectional area of the the impeller I with the shaft 18 and its attendance hub and fittings, and so on through a second stator $S_2$ through the plurality of stages required by the engine 10. For illustrative purposes modifications to the theoretical or ideal tube or venturi is shown as modified geometrically by two stators and one impeller although it is to be understood that the cross-section of the resultant shaft housing 17 shown in the FIG. 2 is shown with a multiplicity of stators and plurality of impellers as determined and calculated in the manner hereinbefore taught, wherein the tube or housing 17 is developed and modified by the cross-sectional area of the operating elements in the housing 17, namely: the shaft 18 the impellers 22, 23, and 24 and the stators 28, 29 and 30 together with such fittings as hubs and brackets for the aforesaid impellers and stators.

Having thus described in detail a preferred apparatus which embodies the concepts and principles of the invention and which accomplishes the various objects, purposes and aims thereof, it is to be appreciated and will be apparent to those skilled in the art that many physical changes could be made in the apparatus without altering the inventive concepts and principles embodied therein. Hence, it is intended that the scope of the invention be limited only to the extent indicated in the appended claims.

I claim:

1. In a jet propulsion engine, including a tapered housing comprising an entranceway at the larger terminal end thereof, a driven shaft journally along the rectilinear center line of said housing, a plurality of impellers having a multiplicity of blades issuing radially from said shaft, a plurality of stators juxtapositioned in said housing alternately between said impellers, said stators having a multiplicity of blades issuing radially from said housing fixation of said stators, the modification of said housing from an ideal geometrical developed tube which provides uniform acceleration of a fluid through said tube to a tube having any transverse section there taken provides an inside net fluid cross sectional area substantially equal to the area of said ideal tube in addition to the area occupied by the material thickness of the respective impellers or stators and said driven shaft at the respective cross section.

2. The apparatus of claim 1 wherein said modification of said housing conforms to the rule:

$Q=AV=\pi r^2V$ and $$r_n=\sqrt{\frac{\pi(r_E^2-r_H^2+r_{Hn}^2)-dA\,l_n}{\pi}}$$

wherein:

Q=Quantity of fluid passing a given point "n" in the closed tube 17 per interval of time n=The length from the entrance 14 of the tube to any point "n" along the longitudinal axis of the tube V=Mean velocity of the fluid of a given cross sectional area at a given point "n" along the longitudinal axis of the tube A=The net cross sectional area of the tube 17 at any point "n" taken in a plane perpendicular to the longitudinal axis 18 of the tube dA=The incremental change of ΔA per unit of length of the tube $r_E$=Radius of the inside of the ideal tube at the entrance $r_H$=Radius of the impeller hub 22 at the entrance of the tube 17

$r_{Hn}$=Radius of the equivalent hub area which includes the blade areas of the impellers, or stators, at any section taken at point "n" along the longitudinal axis of the tube 18

$r_n$=The radius of the inside circular surface of the "ideal tube" or the "modified ideal tube" at any point "n" along the longitudinal axis of the tube.

* * * * *